US011015617B2

(12) United States Patent
Guo et al.

(10) Patent No.: US 11,015,617 B2
(45) Date of Patent: May 25, 2021

(54) REAR GUARD OF BOX FAN AND BOX FAN

(71) Applicants: GD MIDEA ENVIRONMENT APPLIANCES MFG. CO., LTD., Zhongshan (CN); MIDEA GROUP CO., LTD., Foshan (CN)

(72) Inventors: Runming Guo, Zhongshan (CN); Fengxi Yan, Zhongshan (CN); Weiliang Liu, Zhongshan (CN); Xusheng Zhang, Zhongshan (CN); Meihua Deng, Zhongshan (CN); Tuanguang Jiang, Zhongshan (CN)

(73) Assignees: GD MIDEA ENVIRONMENT APPLIANCES MFG. CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 204 days.

(21) Appl. No.: 15/960,417

(22) Filed: Apr. 23, 2018

(65) Prior Publication Data

US 2018/0238352 A1 Aug. 23, 2018

Related U.S. Application Data

(63) Continuation of application No. PCT/CN2016/105190, filed on Nov. 9, 2016.

(30) Foreign Application Priority Data

Nov. 19, 2015 (CN) ..... 201520932110.1

(51) Int. Cl.
*F04D 29/70* (2006.01)
*F04D 25/06* (2006.01)
(Continued)

(52) U.S. Cl.
CPC ..... *F04D 29/703* (2013.01); *F04D 19/002* (2013.01); *F04D 25/06* (2013.01);
(Continued)

(58) Field of Classification Search
CPC ..... F04D 19/703; F04D 19/002; F04D 25/06; F04D 25/0613; F04D 25/08;
(Continued)

(56) References Cited

U.S. PATENT DOCUMENTS 4,413,683 A * 11/1983 Hune ..... A62C 3/00 137/382
5,782,051 A * 7/1998 LaVoie ..... F24F 13/08 454/277

(Continued)

FOREIGN PATENT DOCUMENTS

CN 203476765 U * 3/2014

OTHER PUBLICATIONS

English Translation of CN203476765 (Wu) obtained Jan. 14, 2019 (Year: 2019).*

*Primary Examiner* — Connor J Tremarche
(74) *Attorney, Agent, or Firm* — Morgan, Lewis & Bockius LLP

(57) ABSTRACT

A rear guard of a box fan comprises: a body arranged vertically and a waterproof part arranged on the body. The waterproof part is arranged in a position corresponding to a motor in the box fan and the waterproof part comprises a plurality of recessed structures arranged on the body. a plurality of vent holes are arranged on the body for communicating an inner side of the body with an outer side of the body are arranged in the recessed structures. By arranging the vent holes in the recessed structures, the waterproof effect is realized on the premise of ensuring ventilation, the electric leakage and ignition of the motor can be effectively prevented, and the lifetime of the motor of the box fan is extended.

11 Claims, 5 Drawing Sheets

(51) Int. Cl.

| | |
|---|---|
| ***F04D 25/08*** | (2006.01) |
| ***F04D 29/52*** | (2006.01) |
| ***F04D 19/00*** | (2006.01) |
| ***F04D 29/08*** | (2006.01) |
| ***F04D 29/64*** | (2006.01) |

(52) U.S. Cl.
CPC ..... *F04D 25/0613* (2013.01); *F04D 25/08* (2013.01); *F04D 29/083* (2013.01); *F04D 29/522* (2013.01); *F04D 29/646* (2013.01)

(58) Field of Classification Search
CPC .... F04D 29/083; F04D 29/522; F04D 29/646; F04D 25/082; H02K 1/20; H02K 9/08; H02K 9/06
USPC ..... 417/423.11
See application file for complete search history.

(56) References Cited

U.S. PATENT DOCUMENTS

| | | | | |
|---|---|---|---|---|
| 7,104,753 | B2 * | 9/2006 | Eubank | F04D 29/703 415/121.2 |
| 8,192,179 | B2 * | 6/2012 | Miller | F04D 29/646 415/121.2 |
| 2009/0015082 | A1 * | 1/2009 | Hosoi | H02K 5/10 310/58 |

* cited by examiner

REAR GUARD OF BOX FAN AND BOX FAN

PRIORITY CLAIM AND RELATED APPLICATION

This application is a continuation application of PCT/CN2016/105190, entitled "REAR GUARD OF BOX FAN AND BOX FAN" filed on Nov. 9, 2016, which claims priority to Chinese Patent Application No. 201520932110.1, filed with the State Intellectual Property Office of the People's Republic of China on Nov. 19, 2015, both of which are incorporated herein by reference in their entirety.

FIELD OF TECHNOLOGY

The present disclosure relates to the technical field of motor waterproofness, and particularly to a rear guard of a box fan and a box fan having the same.

BACKGROUND

Fans may be structurally classified into standing fans, box fans, wall fans, table fans or the like. Currently, the rear guards of a majority of the box fans on the market have open structures without a rainproof function. Water vapors, rain drops or dusts pass through the rear guard and enter a housing of a motor directly since the rear guard is open, which reduces the lifetime of the motor, on one hand, and would cause hidden dangers of electric leakage and the ignition of the motor, on the other hand, such that the safety risk of using the box fan in a rainy season or under the bad weather of high humidity is increased. The switches of the existing box fans are not provided with protective devices, so that the rainwater from outside and that splashed by the rotation of the fan blades enter the switches easily, which may cause the switches to be damaged due to short circuit, burn other electronic components up, and even cause a fire.

SUMMARY

(I) Technical Problem to be Solved

The present disclosure aims to solve the technical problem that vapors, rain drops or dusts pass through a rear guard of a box fan and enter a housing of a motor directly since the rear guard of the existing box fan is open, which reduces the lifetime of the motor, and will cause hidden safety dangers of electric leakage and the ignition of the motor.

(II) Technical Solution

In order to solve the technical problem above, the present disclosure provides a rear guard of a box fan comprising a body arranged vertically, a waterproof part arranged on the body, wherein the waterproof part is arranged at a position corresponding to a motor in the box fan, the waterproof part comprises a plurality of recessed structures arranged on the body, and a plurality of vent holes for communicating an inner side of the body with an outer side of the body are arranged in the recessed structures.

In some embodiments, the vent holes are located in the upper parts of the recessed structures.

In some embodiments, each recessed structure comprises a bottom surface and several side walls connected to the bottom surface and the vent holes are arranged at the connection between the bottom surface and the side walls.

In some embodiments, each vent hole is a line-shaped elongated hole or an L-shaped hole.

In some embodiments, the number of the recessed structures is multiple and a plurality of the recessed structures integrally constitutes a circular or annular waterproof part.

According to some embodiments of the present disclosure, a box fan comprises a housing, a plurality of fan blades, a motor, and a rear guard of the box fan as described above. The fan blades are connected to the motor, the fan blades and the motor are arranged in the housing, the rear guard is mounted on the housing, and the motor is opposite to the inner side of the rear guard.

In some embodiments, a rain shade is arranged at the inner side of the rear guard of the box fan and located above the waterproof part.

In some embodiments, the rain shade is an arc-shaped plate of which two ends face downwards.

In some embodiments, a protection hood of the motor is arranged above the motor and is connected to a water guide cover which is located between the motor and the rain shade.

In some embodiments, the protection hood of the motor is made of a refractory material.

In some embodiments, the box fan further comprises a switch for switching operating states of the motor. The switch is provided with a protection unit for preventing the rainwater from outside from entering the switch.

In some embodiments, the switch is arranged on the rear guard of the box fan, the protection unit is a switch protection box arranged at an outer side of the switch.

In some embodiments, the switch is arranged on the rear guard, the protection unit is a water fender arranged between the fan blades and the switch.

(III) Advantageous Effect

The technical solutions above have the following merits: according to the rear guard in the present disclosure, the ventilation of the box fan is ensured by arranging the vent holes; by arranging the vent holes in the recessed structures, the rainwater may flow out downwards along the recessed structures without entering the vent holes, that is, the waterproof effect is realized on the premise of ensuring ventilation and the rainwater from outside is prevented from falling into the vent holes during ventilation; by arranging the vent holes in upper parts of the recessed structures, the probability that rainwater is splashed into the vent holes is further reduced, and the waterproof effect is further improved.

According to the box fan described in the present disclosure, the rear end of the motor is directly opposed to the waterproof part of the rear guard, so that the rainwater will not directly flow into the motor through the waterproof part on the premise of realizing ventilation and heat dissipation; by arranging the rain shade and the water guide cover, the rainwater entering from other regions of the rear window can be guided to the regions other than the motor to flow down such that the rainwater is completely prevented from entering the motor, therefore the electric leakage and the ignition of the motor can be effectively prevented, and the lifetime of the motor is extended; since the protection hood of the motor is made of the refractory material, the ignition of the fan blades may be prevented and the waterproof and fireproof requirements of the motor are met; and since the switch is provided with a protection unit which is a switch protection box especially, the switch is comprehensively protected so as to prevent the rainwater from entering the switch and ensure the normal operation of the switch and the safety.

Figure 1:
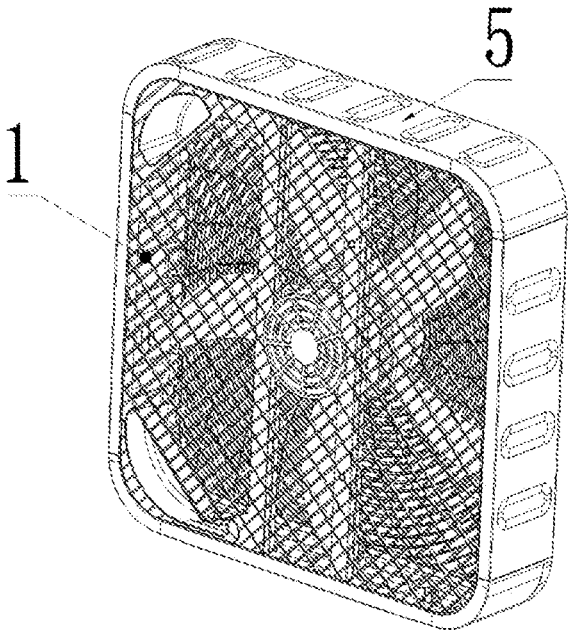
FIG. 1 is one of the structural schematic diagrams illustrating a box fan according to some embodiments of the present disclosure.
Figure 2:
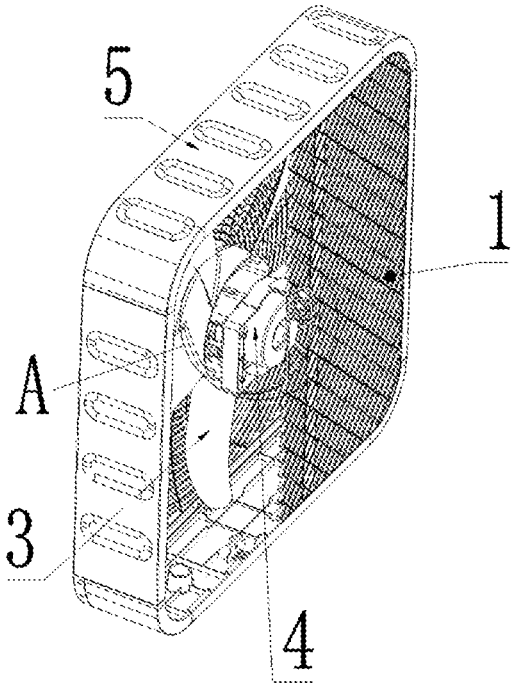
FIG. 2 is one of the structural schematic diagrams illustrating the box fan according to some embodiments of the present disclosure.
Figure 3:
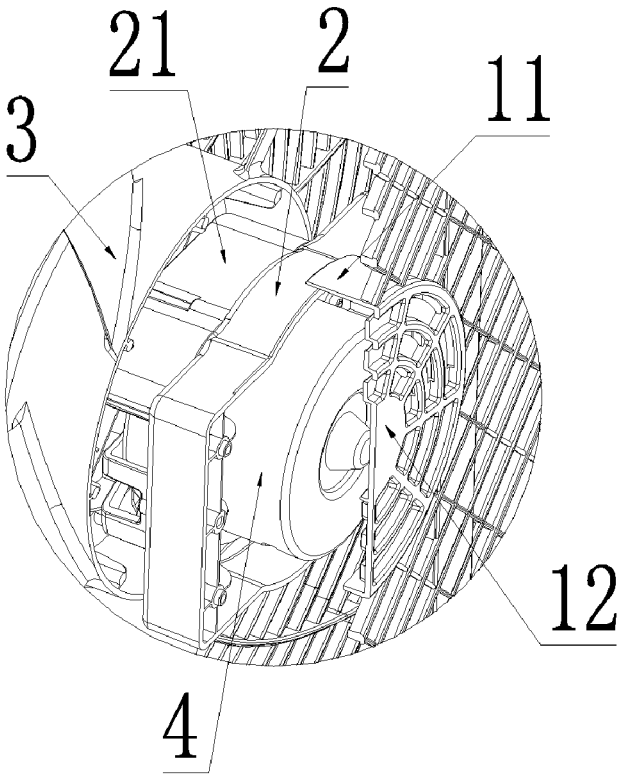
FIG. 3 is a partial enlarged view illustrating portion A in FIG. 2.
Figure 4:
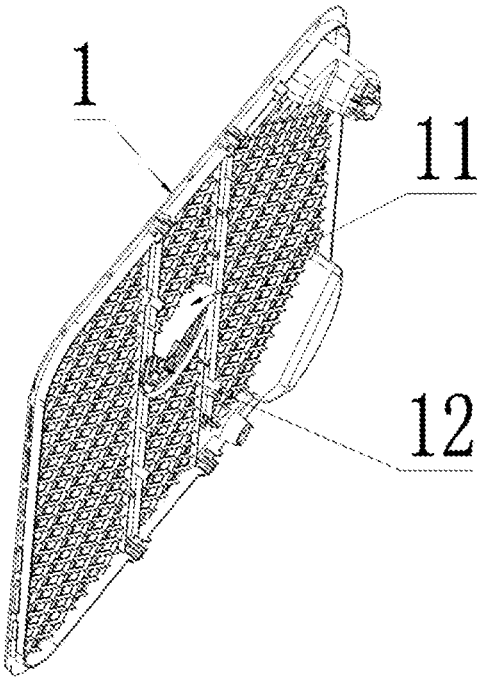
FIG. 4 is a structural schematic diagram illustrating a rear guard according to some embodiments of the present disclosure.
Figure 5:
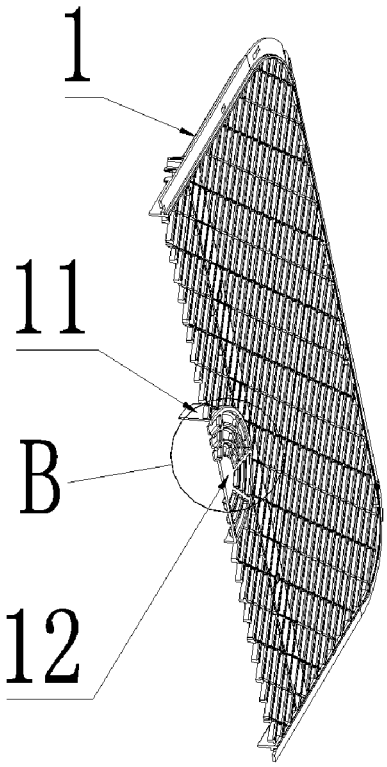
FIG. 5 is a half-sectional structural schematic diagram illustrating the rear guard according to some embodiments of the present disclosure.

Wherein 1: a rear guard of a box fan; 11: rain shade; 12: waterproof part; 121: bottom surface; 122: side wall; 123: vent hole; 2: protection hood of motor; 21: water guide cover; 4: motor; 3: fan blade; 5: housing; 6: switch; and 7: protection unit.

DESCRIPTION OF THE EMBODIMENTS

The embodiments of the present disclosure are described in more detail hereinafter in conjunction with the accompanying drawings and examples. The following embodiments are intended to illustrate the present disclosure, but not to limit the scope thereof.

In the description of the present disclosure, it should be noted that unless indicated otherwise, "multiple" means two or more than two; the orientation or position relations indicated by terms "above", "below", "left", "right", "internal", "external", "front", "rear", "head", "tail" etc. are the orientation or position relations based on the illustration of the accompanying drawings, which are only for the sake of describing the present disclosure and simplifying the description, but do not indicate or imply that the devices or elements referred must have specific orientations, or be constructed and operated at the specific orientations. Therefore, the orientation or position relations cannot be construed to limit the present disclosure. In addition, terms "first", "second" and "third" are for descriptive purpose only, but cannot be construed to indicate or imply the relative importance.

In the description of the present disclosure, it also should be noted that unless expressly stated and defined otherwise, terms "mount", "link", "connect" should be broadly construed, for example, it may be fixedly connected, detachably connected or integrally connected; it may be mechanically connected or electrically connected; it may be directly connected or indirectly connected via intermediate medium. For those of ordinary skill in the art, the specific meanings of the terms above in the present disclosure may be construed according to specific conditions.

First Embodiment

As illustrated in FIG. 4-7, the embodiment discloses a rear guard of a box fan comprising: a body arranged vertically, a waterproof part 12 arranged on the body; wherein the waterproof part 12 is arranged at a position corresponding to a motor 4 in the box fan, the waterproof part 12 comprises recessed structures arranged on the body and vent holes 123 for communicating both an inner side and an outer side of the body are arranged in the recessed structures.

Rainwater and dust from outside generally fall from the inclined top or top of the box fan due to gravity; since the vent holes 123 are arranged within the recessed structures instead of being directly exposed to the outside of the body, the rainwater and dust are blocked even if they fall from the inclined top of the box fan, can only flow down along the outer surface of the body, do not directly fall into the vent hole 123, and do not even enter the inner side of the body from the vent holes 123 in the recessed structures. Therefore, the rainproof and waterproof effects are realized while achieving the ventilation and heat dissipation.

Specifically, the recessed structures are arranged at the upper half of the waterproof part 12 and the vent holes 123 are located at the upper parts of the recessed structures. Each recessed structure comprises a bottom surface 121 and several side walls 122 connected to the bottom surface 121, each vent hole 123 is arranged at the connection between the bottom surface 121 and the side walls 122. The vent hole 123 is a line-shaped elongated hole or an L-shaped hole; that is, the vent hole 123 is either arranged at the connection between the bottom surface 121 and one of the side walls 122 to form the line-shaped elongated hole or arranged between the bottom surface 121 and two adjacent side walls 122 to form the L-shaped hole.

Figure 6:
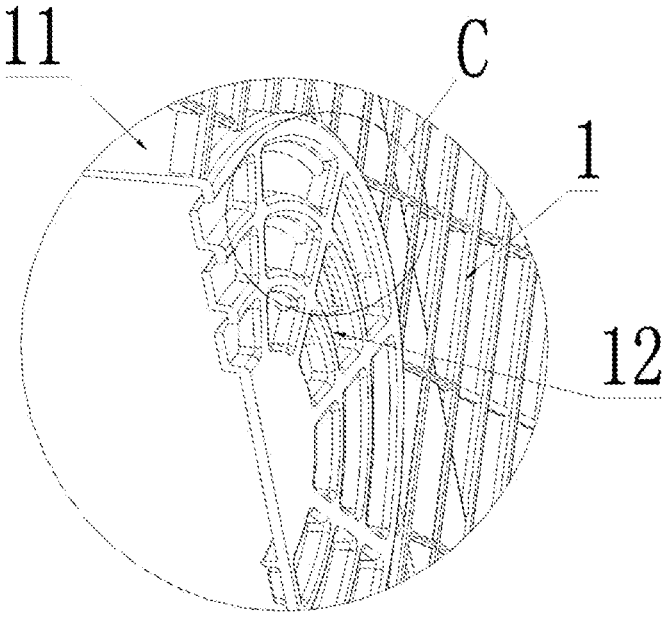
FIG. 6 is a partial enlarged view illustrating portion B in FIG. 5.
Figure 7:
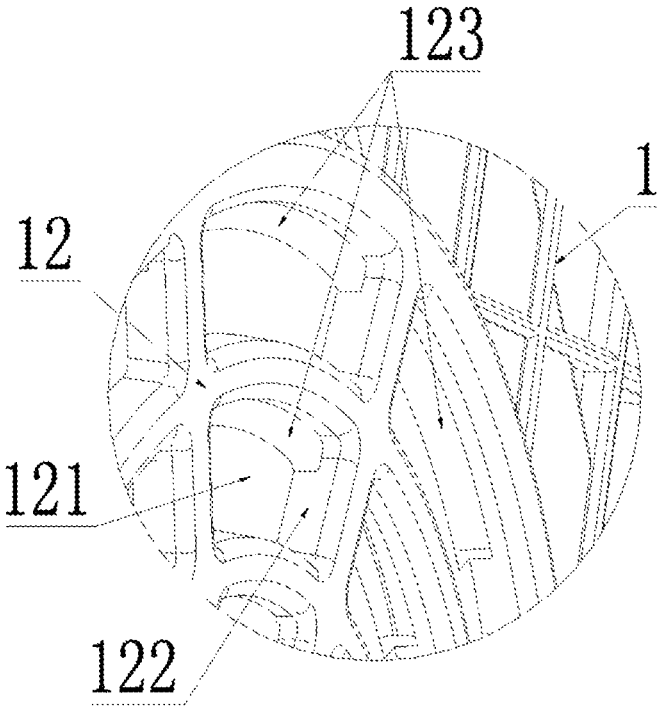
FIG. 7 is a partial enlarged view illustrating portion C in FIG. 6.

As illustrated in FIGS. 6 and 7, the number of the recessed structures is multiple, and a plurality of the recessed structures integrally constitutes a circular or an annular waterproof part 12.

For the convenience of manufacturing, the waterproof portion 12 is integrally arranged in a circular shape, and the plurality of the recessed structures is uniformly distributed in the circular area. However, only the recessed structures arranged on the upper half are provided with vent holes 123 so as to prevent the rainwater from the upper parts from flowing into the vent holes 123 within the recessed structures at the lower portion. In order to further improve the rainproof and water proof effects, the vent holes 123 are arranged at the connections between the upper edge of the bottom surface 121 and the side walls 122, as illustrated in FIGS. 6 and 7. In this way, the rainwater will be blocked directly by the side walls 122 after it falls, and will not fall into the vent holes 123 at the bottoms of the side walls 122; even if a part of the rainwater falls into the recessed structures, the rainwater will not flow into the inner side of the body from the vent holes 123 since the vent holes 123 are located at the upper edge of the bottom surface 121. Therefore, these rainproof and waterproof multi-functions are further realized on the premise of achieving the ventilation.

Second Embodiment

As illustrated in FIG. 1-3 and FIG. 9, the present embodiment specifically discloses a box fan, comprising a housing 5, fan blades 3, a motor 4, and a rear guard 1 according to the first embodiment; wherein the fan blades 3 are connected to the motor 4, both the fan blades 3 and the motor 4 are arranged in the housing 5, the rear guard 1 is mounted on the housing 5 and the motor 4 is arranged opposite to the inner side of the rear guard 1.

That is, the ventilation and protection are realized for the motor 4 by means of the rear guard according to the first embodiment, so as to prevent the rainwater from entering the motor 4 from the rear guard 1 during application, and to achieve the waterproof effect while ensuring the normal ventilation for the motor 4.

Specifically, the motor 4 is arranged opposite to the waterproof part 12. The fan blades 3 are mounted on the main shaft at the front end of the motor 4, the rear end of the motor 4 is arranged opposite to the waterproof part 12 so as to mainly achieve protection on the motor 4 and prevent the rainwater from outside from entering the motor 4.

Further, a rain shade 11 is arranged on the inner side of the rear guard 1 and located above the waterproof part 12. The rain shade 11 is an arc-shaped plate of which two ends face downward. Since a large amount of airflow will pass through the rear window as the fan blades 3 rotate, it cannot realize the waterproof function if a conventional grid structure is adopted at the region around the waterproof part 12. In order to prevent the rainwater from outside from entering the motor 4 through the grid structure, by arranging the rain shade 11 above the waterproof part 12, the rainwater coming in from above the motor 4 can be blocked and guided to other regions to flow out, thereby effectively preventing the water from flowing into the motor 4.

Figure 8:
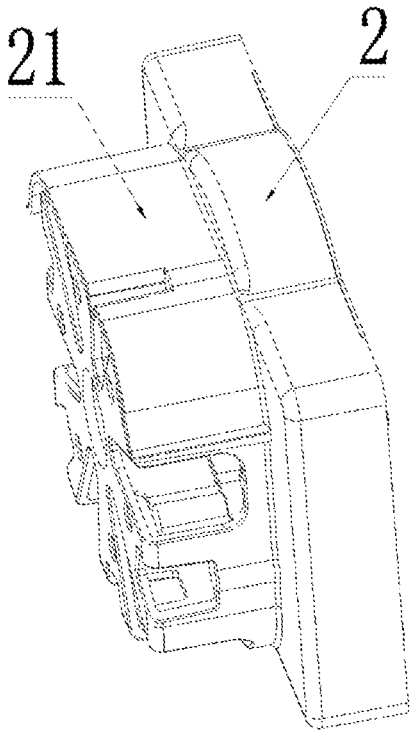
FIG. 8 is a structural schematic diagram illustrating a protection hood of a motor according to some embodiments of the present disclosure.

Further, a protection hood 2 of the motor is arranged above the motor 4 and is connected to a water guide cover 21 (depicted in FIG. 8) which is located between the motor 4 and the rain shade 11. The rainwater from the rain shade 11 may fall down from other regions along the protection hood 2 of the motor and the water guide cover 21 located below the box fan without falling into the motor 4.

In some embodiments, the protection hood 2 of the motor is made of a refractory material. Since the fan blades 3 are easily heated up and catch on fire when they rotate at a high speed, the ignition of the fan blades 3 may be effectively prevented by using the protection hood 2 of the motor made of the refractory material so as to ensure the safety during use.

Third Embodiment

Figure 9:
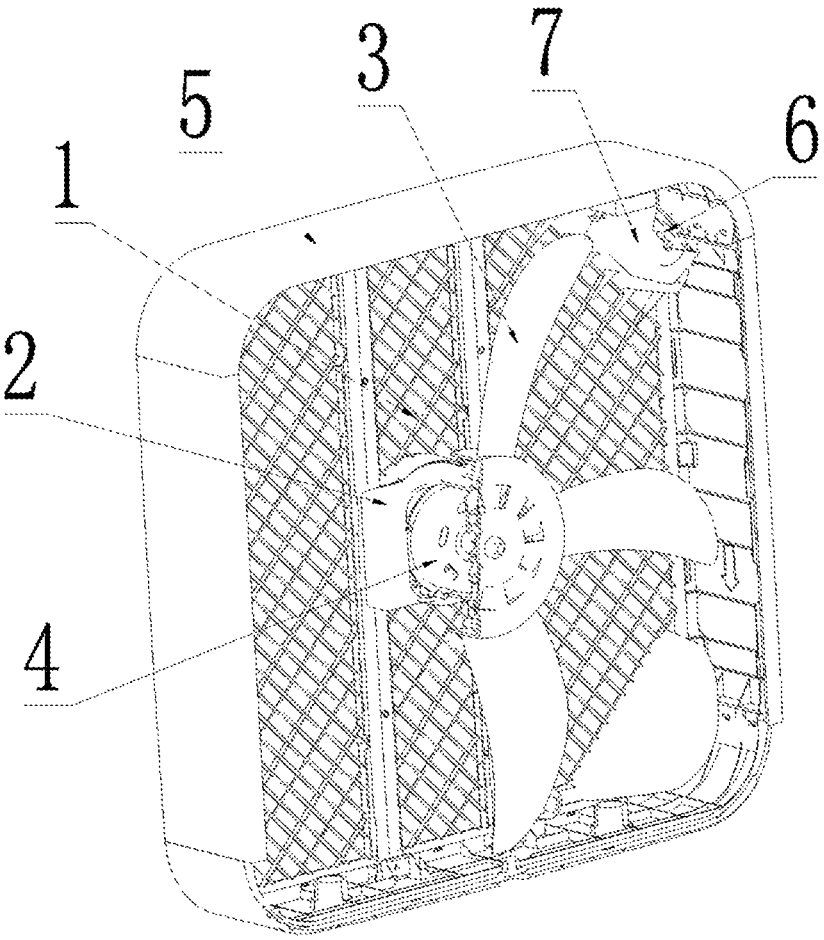
FIG. 9 is a structural schematic diagram illustrating the box fan according to some embodiments of the present disclosure.

As illustrated in FIG. 9, the present embodiment is further improved on the basis of the second embodiment. The box fan further comprises a switch 6 for switching the operating states of the motor 4 and the switch 6 is provided with a protection unit 7 for preventing the rainwater from outside from entering the switch 6. By arranging the protection unit 7, the switch 6 can be effectively protected against rainwater, so as to avoid electric leakages and short circuits caused by entered rainwater, and to ensure the normal operation of the switch 6 and safety.

In some embodiments, the switch 6 is arranged on the rear guard 1 and the protection unit 7 is a switch protection box arranged at the outer side of the switch 6. The switch protection box may have multi-direction and comprehensive protection on the switch 6 so as to prevent rainwater coming into the switch 6, which has the best protection effect.

In some embodiments, the switch 6 is arranged on the rear guard 1 and the protection unit 7 is a water fender arranged between the fan blades 3 and the switch 6. Due to the centrifugal force generated during the rotation of the fan blades 3, the water on the fan blades 3 is thrown out to be splashed onto the switch 6. Therefore, a water fender is arranged between the fan blades 3 and the switch 6 as the protection unit 7 so as to block the water drops splashed by the fan blades 3, and ensure the normal operation of the switch 6 and safety.

It can be seen from the above embodiments that, according to the rear guard of the first embodiment of the present disclosure, the ventilation of the box fan is ensured by arranging the vent holes 123; by arranging the vent holes 123 within the recessed structures, the rainwater can flow out downwards along the recessed structures and will not enter the vent holes 123, that is, the waterproofness is realized on the premise of ensuring ventilation, therefore the rainwater from outside is prevented from falling into the vent holes 123 during ventilation; by arranging the vent holes 123 in upper parts of the recessed structures, the probability that the rainwater is splashed into the vent holes 123 is further reduced, and the waterproof effect is further improved. According to the box fan of the second embodiment of the present disclosure, by arranging the rear end of the motor 4 directly opposite to the waterproof part 12 of the rear guard 1, the rainwater will not directly flow to the motor 4 through the waterproof part 12 on the premise of realizing ventilation and heat dissipation; by arranging the rain shade 11 and the water guide cover 21, the rainwater inflowing from other regions of the rear window can be guided into the regions other than the motor 4 and flow down, such that the rainwater is completely prevented from entering the motor 4, the electric leakage and ignition of the motor 4 are effectively prevented, and the lifetime of the motor 4 is extended; by arranging the protection hood 2 of the motor made of the refractory material, the ignition of the fan blades 3 can be prevented so as to meet the waterproof and fireproof requirements of the motor 4; the switch 6 is arranged with a protection unit 7, so that the switch 6 is comprehensively protected especially when the protection unit 7 is a switch protection box, and the rainwater is prevented from entering the switch 6, thereby ensuring the normal operation of the switch 6 and safety.

While the embodiments of the present disclosure are only described above, it should be noted to those skilled in the art that various modifications and alternatives may be made without departing from the technical principles of the present disclosure, and these modifications and alternatives should also be regarded as the protection scope of the present disclosure.

What is claimed is:

1. A rear guard of a box fan, comprising:

a body arranged vertically; and a waterproof part arranged on the body, the waterproof part being arranged in a position corresponding to a motor in the box fan, wherein:

the waterproof part comprises a plurality of recessed structures arranged on the body, a respective recessed structure of the plurality of recessed structure comprises respective side walls connected to a respective bottom surface at a perpendicular angle, and a respective vent hole of a plurality of vent holes for communicating an inner side of the body with an outer side of the body is arranged in a respective upper part of the respective recessed structure and at a respective connection between an upper edge of the respective bottom surface and the respective side walls.

2. The rear guard according to claim 1, wherein the respective vent hole is one selected from the group consisting of a line-shaped elongated hole, an L-shaped hole and a combination thereof.

3. The rear guard according to claim 1, wherein the plurality of recessed structures integrally constitute the waterproof part.

4. A box fan, comprising:

a housing;

a plurality of fan blades;

a motor; and a rear guard, wherein the rear guard further comprises a body arranged vertically and a waterproof part arranged on the body, the waterproof part being arranged in a position corresponding to the motor in the box fan, wherein the waterproof part further comprises a plurality of recessed structures arranged on the body, and a plurality of vent holes for communicating an inner side of the body with an outer side of the body being arranged in the plurality of recessed structures; wherein:

the plurality of fan blades are connected to the motor, both the plurality of fan blades and the motor are arranged in the housing, the rear guard is mounted on the housing and the motor is arranged opposite to an inner side of the rear guard, a respective recessed structure of the plurality of recessed structure comprises respective side walls connected to a respective bottom surface at a perpendicular angle, and a respective vent hole is arranged in a respective upper part of the respective recessed structure and at a respective connection between an upper edge of the respective bottom surface and the respective side walls.

5. The box fan of claim 4, wherein a rain shade is arranged at the inner side of the rear guard and located above the waterproof part.

6. The box fan of claim 5, wherein the rain shade is an arc-shaped plate having two ends facing downward.

7. The box fan of claim 5, wherein a protection hood of the motor is arranged above the motor and is connected to a water guide cover located between the motor and the rain shade.

8. The box fan of claim 7, wherein the motor protection hood is made of a refractory material.

9. The box fan of claim 4, further comprising a switch for switching an operating state of the motor, wherein the switch is provided with a protection unit for preventing outside rainwater from entering the switch.

10. The box fan of claim 9, wherein the switch is arranged on the rear guard and the protection unit is a switch protection box arranged at an outer side of the switch.

11. The box fan of claim 9, wherein the switch is arranged on the rear guard and the protection unit is a water fender arranged between the plurality of fan blades and the switch.

* * * * *